US011477572B2

(12) United States Patent
Kamata et al.

(10) Patent No.: US 11,477,572 B2
(45) Date of Patent: Oct. 18, 2022

(54) SPEAKER DRIVE UNIT, SPEAKER APPARATUS, AND SPEAKER DRIVING METHOD

(71) Applicant: SONY CORPORATION, Tokyo (JP)

(72) Inventors: Masaki Kamata, Tokyo (JP); Naoki Shinmen, Tokyo (JP); Michiaki Yoneda, Tokyo (JP); Yoshiyuki Kuroda, Tokyo (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 17/277,789

(22) PCT Filed: Jul. 3, 2019

(86) PCT No.: PCT/JP2019/026434
§ 371 (c)(1),
(2) Date: Mar. 19, 2021

(87) PCT Pub. No.: WO2020/070934
PCT Pub. Date: Apr. 9, 2020

(65) Prior Publication Data

US 2021/0352407 A1 Nov. 11, 2021

(30) Foreign Application Priority Data

Oct. 1, 2018 (JP) ..... JP2018-186761

(51) Int. Cl.
*H04R 3/04* (2006.01)
*H04R 9/06* (2006.01)

(52) U.S. Cl.
CPC ..... *H04R 3/04* (2013.01); *H04R 9/06* (2013.01)

(58) Field of Classification Search
None
See application file for complete search history.

(56) References Cited

U.S. PATENT DOCUMENTS 5,588,065 A * 12/1996 Tanaka ..... H04R 3/002 381/59
2005/0031137 A1* 2/2005 Browning ..... H04R 9/00 381/59

(Continued)

FOREIGN PATENT DOCUMENTS

EP 3343272 A1 7/2018
JP 55-025284 A 2/1980

(Continued)

OTHER PUBLICATIONS

International Search Report and Written Opinion of PCT Application No. PCT/JP2019/026434, dated Aug. 6, 2019, 11 pages of ISRWO.

*Primary Examiner* — James K Mooney
(74) *Attorney, Agent, or Firm* — Chip Law Group

(57) ABSTRACT

A speaker drive unit includes a control signal generation unit and a signal processing unit. The control signal generation unit generates a control signal on the basis of detection signals generated by a plurality of detection units that is disposed in one-to-one correspondence with a plurality of actuators that vibrates a diaphragm, and detects vibration conditions. The signal processing unit includes a plurality of signal systems corresponding one-to-one to the plurality of actuators. The signal systems provide a drive signal to the corresponding actuators on the basis of the same audio signal. The drive signal generated by at least one signal system of the signal systems is controlled by the control signal.

15 Claims, 14 Drawing Sheets

(56) References Cited

U.S. PATENT DOCUMENTS

| | | | |
|---|---|---|---|
| 2007/0001631 | A1 | 1/2007 | Suzuki et al. |
| 2017/0280215 | A1 | 9/2017 | Lee et al. |

FOREIGN PATENT DOCUMENTS

| | | | |
|---|---|---|---|
| JP | 55-25285 | A | 2/1980 |
| JP | 57-99099 | A | 6/1982 |
| JP | 2007-013891 | A | 1/2007 |
| JP | 20114319 | A | 1/2011 |
| JP | 2018-110369 | A | 7/2018 |
| KR | 10-1817105 | B1 | 2/2018 |

* cited by examiner

SPEAKER DRIVE UNIT, SPEAKER APPARATUS, AND SPEAKER DRIVING METHOD

CROSS REFERENCE TO RELATED APPLICATIONS

This application is a U.S. National Phase of International Patent Application No. PCT/JP2019/026434 filed on Jul. 3, 2019, which claims priority benefit of Japanese Patent Application No. JP 2018-186761 filed in the Japan Patent Office on Oct. 1, 2018. Each of the above-referenced applications is hereby incorporated herein by reference in its entirety.

TECHNICAL FIELD

The present technology relates to a speaker drive unit, a speaker apparatus, and a speaker driving method, and more particularly, relates to control of a vibratory drive system with a plurality of actuators.

BACKGROUND ART

Patent Document 1 describes a multipoint-drive speaker unit in which one diaphragm is driven by a plurality of actuators (also referred to as drivers).

CITATION LIST

Patent Document

Patent Document 1: Japanese Patent Application Laid-Open No. S55-25285

SUMMARY OF THE INVENTION

Problems to be Solved by the Invention

For multipoint-drive speaker units as described above, for example, or speaker systems each of which drives diaphragms with the same audio signal while driving each diaphragm with one actuator to achieve an increase in volume, or the like, it is desirable that driving conditions produced by the actuators be made uniform.

For example, for a multipoint-drive speaker unit, variations caused by actuators result in a deterioration in sound quality due to rolling or the like.

It is thus an object of the present technology to achieve an improvement in sound quality in diaphragm driving with a plurality of actuators.

Solutions to Problems

A speaker drive unit according to the present technology includes a control signal generation unit that generates a control signal on the basis of detection signals generated by a plurality of detection units that is disposed in one-to-one correspondence with a plurality of actuators that vibrates a diaphragm, and detects vibration conditions, and a signal processing unit that includes a plurality of signal systems corresponding one-to-one to the plurality of actuators, the signal systems providing a drive signal to the corresponding actuators on the basis of the same audio signal, the drive signal generated by at least one signal system of the signal systems being controlled by the control signal.

All or part of the drive signals to the plurality of actuators that drives the diaphragm of the speaker is/are controlled by the control signal(s) based on the detection signals from the detection units.

In the speaker drive unit according to the present technology described above, the control signal generation unit may generate a control signal to each of the plurality of signal systems, and the drive signal of each of the plurality of signal systems may be controlled by the control signal in the signal processing unit.

All of the signal systems corresponding one-to-one to the plurality of actuators are configured to perform signal processing according to the control signals.

In the speaker drive unit according to the present technology described above, the control signal generation unit may generate a control signal to make the detection signals of the plurality of detection units uniform.

That is, the control signal generation unit generates a control signal to control the drive signal so as to eliminate difference between the detection signals.

In the speaker drive unit according to the present technology described above, the control signal may be a signal to control gain of the drive signal of the signal system.

That is, the amplitude of the drive signal is controlled to control vibrations produced by the plurality of actuators.

In the speaker drive unit according to the present technology described above, the control signal may be a signal to control frequency response of the drive signal of the signal system.

That is, the frequency responses of the drive signals of the actuators are adjusted between the signal systems.

In the speaker drive unit according to the present technology described above, the control signal generation unit may generate a control signal for feedback control using detection signals of acceleration of vibrations produced by the actuators.

For example, the feedback control is performed so that the detection signals of acceleration of vibrations produced by the actuators are made uniform.

In the speaker drive unit according to the present technology described above, the control signal generation unit may determine an average value of the detection signals of the plurality of detection units, and generate a control signal using the average value.

For example, a control loop is configured such that with reference to an average value of the detection signals, the detection signals converge to the average value.

In the speaker drive unit according to the present technology described above, the plurality of actuators may be actuators that drive the same diaphragm.

That is, they are actuators of a multipoint-drive speaker unit.

In the speaker drive unit according to the present technology described above, the plurality of actuators may be actuators each or each part of which drives a different diaphragm.

That is, in a system that reproduces sounds by a combination of a plurality of speaker units, each actuator is an actuator of the corresponding speaker unit.

Alternatively, in a speaker unit having a plurality of independent diaphragms, each actuator is an actuator for the corresponding diaphragm.

In the speaker drive unit according to the present technology described above, the plurality of actuators may be actuators that vibrate an image display panel in a configuration in which the image display panel is used as a diaphragm.

That is, an apparatus that outputs sounds by actuators vibrating an image display panel is considered.

In the speaker drive unit according to the present technology described above, the detection units may be acceleration detection units or drive current detection units for the actuators, or include bridge circuits.

That is, the control signal generation unit generates control signals to control the drive signals of the actuators on the basis of acceleration detection signals as signals indicating the vibration conditions of the diaphragm.

Alternatively, the control signal generation unit obtains detection signals of drive currents of the actuators as signals indicating the vibration conditions of the diaphragm, and generates control signals to control the respective drive signals of the actuators on the basis of the detection signals.

Alternatively, the control signal generation unit obtains detection signals of, for example, motional feed back (MFB) bridge circuits as signals indicating the vibration conditions of the diaphragm, and generates control signals to control the respective drive signals of the actuators on the basis of the detection signals.

A speaker apparatus according to the present technology includes a plurality of actuators that vibrates the diaphragm, a plurality of detection units that is disposed in one-to-one correspondence with the plurality of actuators, and detects vibration conditions, the above-described control signal generation unit, and the above-described signal processing unit.

A speaker driving method according to the present technology includes generating a control signal on the basis of detection signals generated by a plurality of detection units that is disposed in one-to-one correspondence with a plurality of actuators that vibrates a diaphragm, and detects vibration conditions, and controlling, by the control signal, a drive signal of at least one signal system of a plurality of signal systems corresponding one-to-one to the plurality of actuators, the signal systems providing a drive signal to the corresponding actuators on the basis of the same audio signal.

This controls diaphragm driving by the actuators.

MODE FOR CARRYING OUT THE INVENTION

Hereinafter, embodiments will be described in the following order.

<1. Structure of multipoint-drive speaker unit>
<2. First embodiment>
<3. Second embodiment>
<4. Third embodiment>
<5. Fourth embodiment>
<6. Fifth embodiment>
<7. Applicable speaker examples>
<8. Display device configuration>
<9. Summary and modifications>

1. Structure of Multipoint-Drive Speaker Unit

As an embodiment of the present disclosure, a speaker apparatus 1 as a multipoint-drive speaker will be described.

Figure 1:
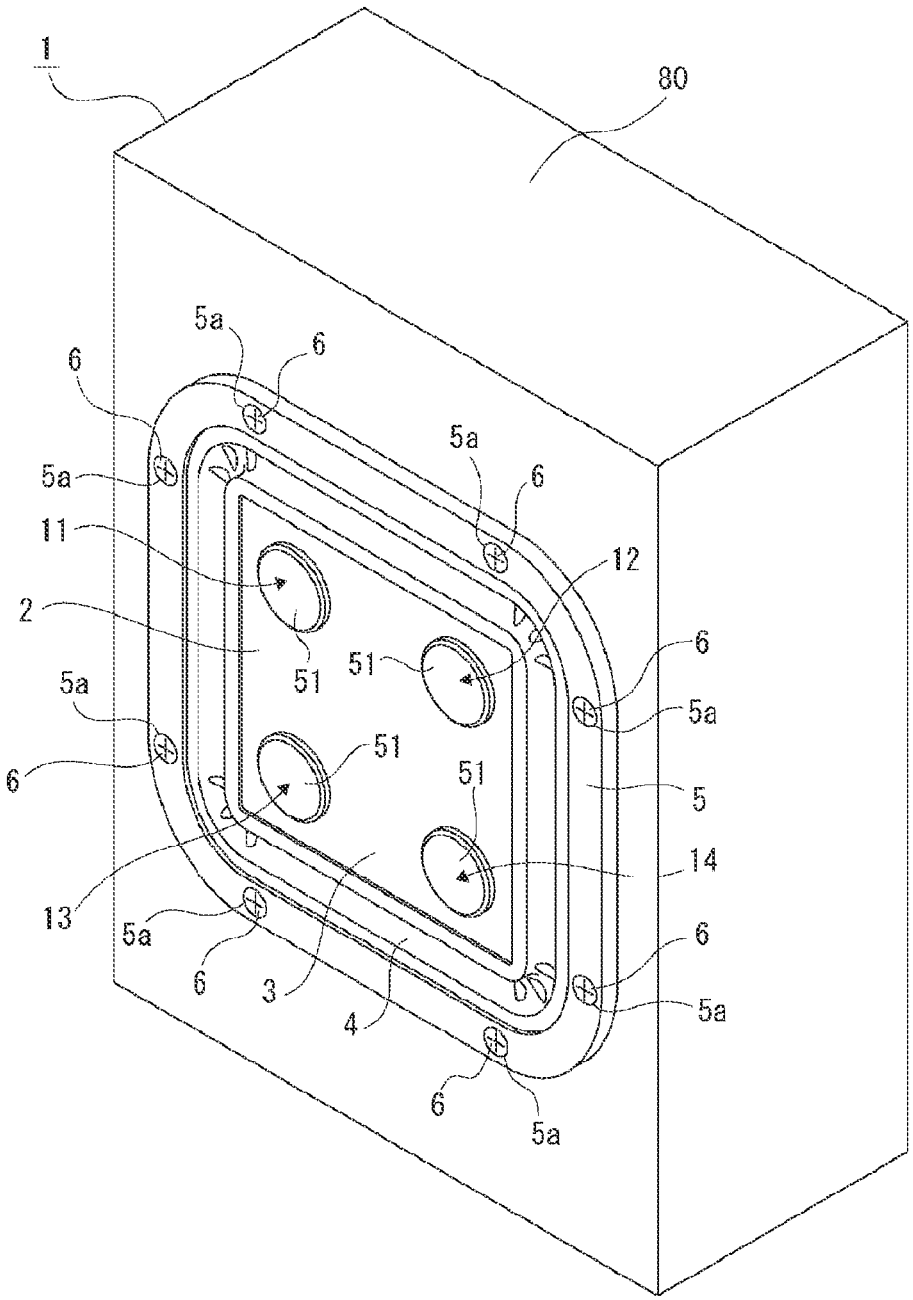
FIG. 1 is a perspective view of a speaker apparatus according to an embodiment of the present technology.

FIG. 1 shows the speaker apparatus 1. The speaker apparatus 1 in this example is a closed speaker with a speaker unit 2 mounted to the front surface of a speaker cabinet 80. This is one example, and a speaker apparatus of the present technology to be described below is not limited to such a single speaker. For example, it may be a speaker apparatus mounted to a housing of equipment such as a display device, an information processing device, or a portable terminal.

The speaker unit 2 mounted on the speaker apparatus 1 in FIG. 1 moves a planar diaphragm 3 with multipoint drive drivers.

In FIG. 1, four actuators (11, 12, 13, and 14) described later are provided as the multipoint drive drivers for the diaphragm 3. FIG. 1 shows their voice coil caps 51 appearing on the surface of the diaphragm 3.

Each voice coil cap 51 is a cap that covers the front surface of a voice coil bobbin 52 described later (see FIG. 3).

The speaker unit 2 thus has four driving points for the single diaphragm 3. Note that from the feature of a multipoint drive system that "by driving a diaphragm at the positions of specific divided vibration nodes, the divided vibration can be eliminated", the voice coil bobbins 52 are bonded to the diaphragm 3 at four node positions.

Figure 2:
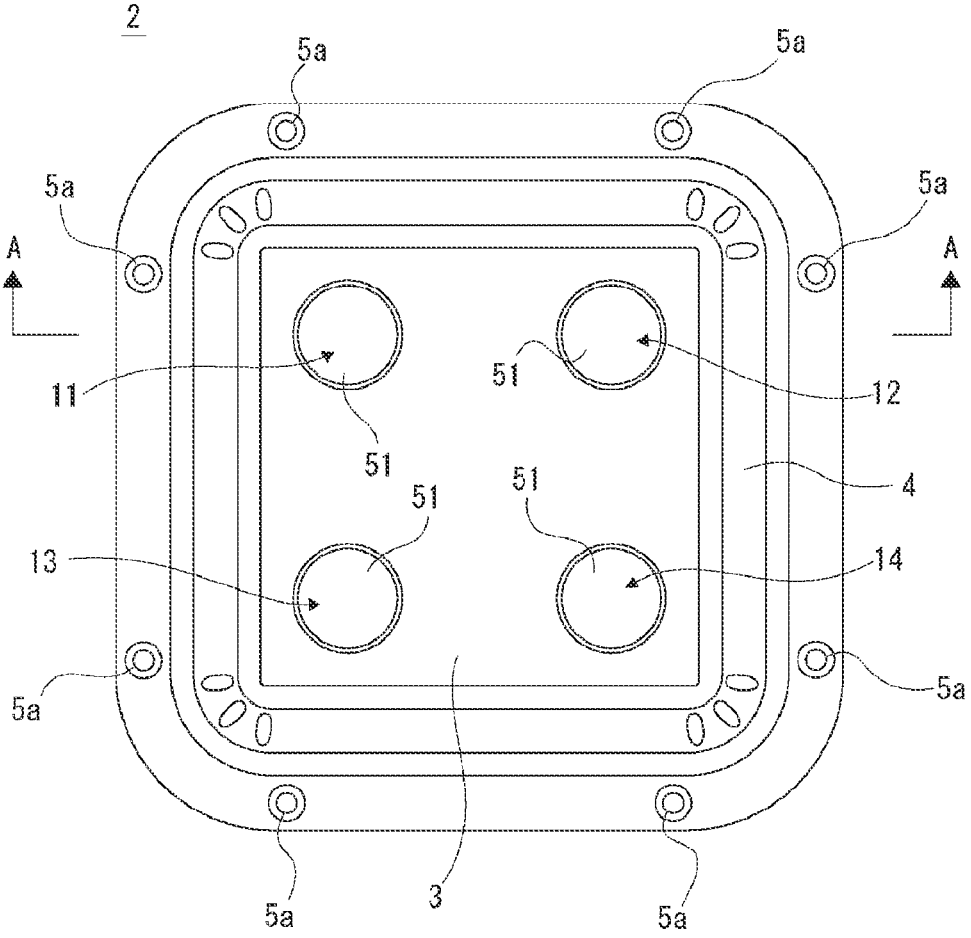
FIG. 2 is a front view of a speaker unit according to the embodiment.

FIG. 2 is a front view of the speaker unit 2. FIG. 3 is an A-A cross-sectional view of FIG. 2.

The diaphragm 3 is mounted to a frame 5 via an edge 4.

The frame 5 is provided with screw holes 5*a* at required positions as in FIG. 2. As in FIG. 1, the speaker unit 2 is mounted to the speaker cabinet 80 by screws 6 being inserted into the screw holes 5*a*.

Figure 3:
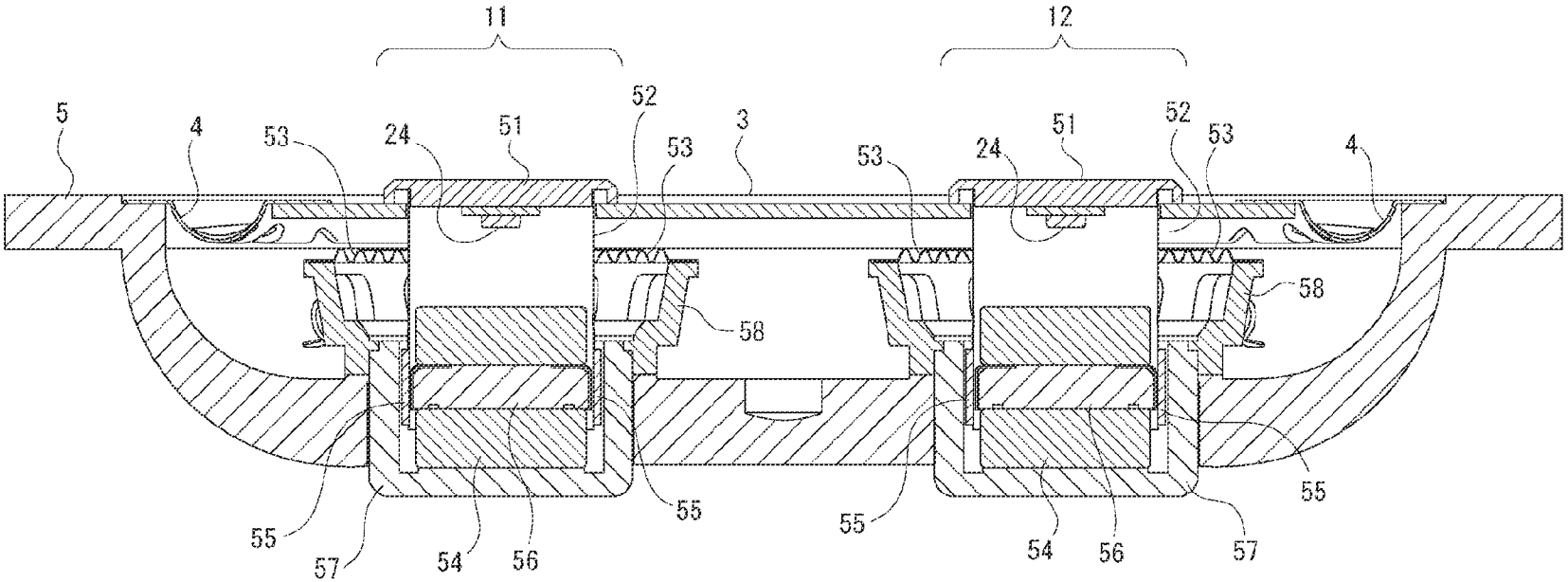
FIG. 3 is an A-A cross-sectional view of the speaker unit in the embodiment.

FIG. 3 shows a part of the actuators 11 and 12. The four actuators 11, 12, 13, and 14 have the same structure. The actuators 11, 12, 13, and 14 each include the voice coil cap 51, the voice coil bobbin 52, a damper 53, a magnet 54, a voice coil 55, a short ring 56, a yoke 57, and a subframe 58.

The yoke 57 is attached to the frame 5. The magnet 54 is disposed in the yoke 57. Further, the short ring 56 is wound around the peripheral surface of the magnet 54.

The voice coil bobbin 52 is disposed with the magnet 54 and the short ring located in its cylinder. The voice coil 55 is wound around the voice coil bobbin 52. The voice coil 55 is located in a gap portion between the yoke 57 and the voice coil bobbin 52.

The subframe 58 is fixed to the frame 5 at the disposed location of the yoke 57. The damper 53 is provided between the voice coil bobbin 52 and the subframe 58, whereby the voice coil bobbin 52 is supported such that it can make piston movement.

The voice coil cap 51 is attached to the front end of the voice coil bobbin 52 as described above. The voice coil bobbin 52 is bonded to the diaphragm 3 at the front end. Thus, the diaphragm 3 is driven by the movement of the voice coil bobbin 52.

Note that the positions at which the diaphragm 3 is driven to vibrate by the actuators 11, 12, 13, and 14 (that is, the positions at which the voice coil bobbins 52 are bonded) are referred to as driving points.

In the case of the present embodiment, a sensor 24 is attached to each voice coil cap 51. The sensor 24 may be, for example, a three-axis acceleration sensor.

Figure 4A:
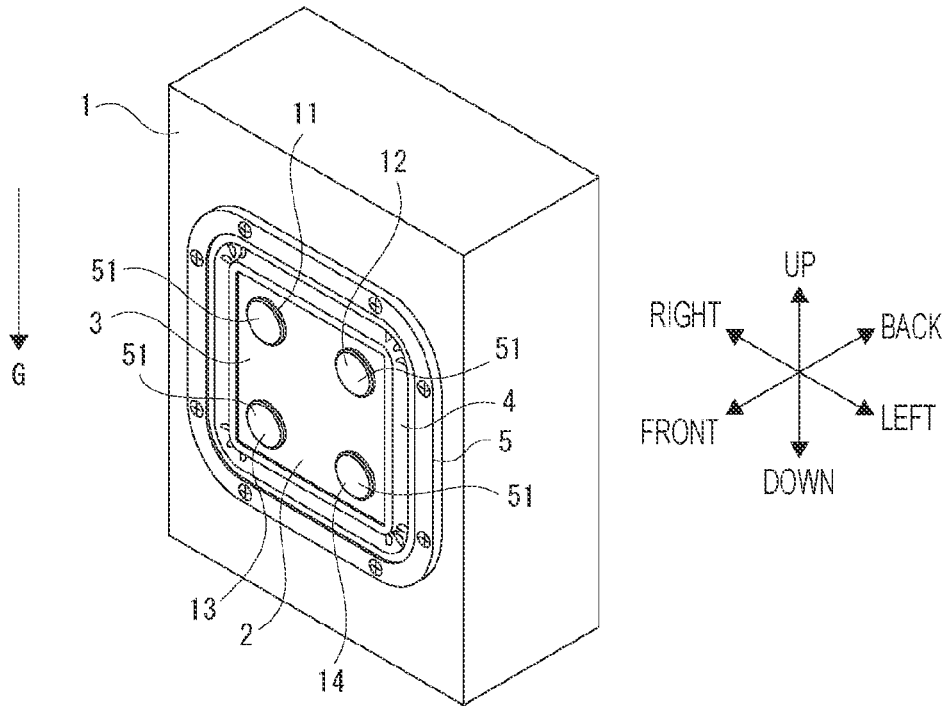
FIGS. 4A and 4B are explanatory diagrams of a disposed position of the speaker apparatus in the embodiment.

The three axes in this case are, as shown in FIG. 4A, an axis in the front-back direction, an axis in the left-right direction, and an axis in the up-down direction when the front direction of the speaker is the front. Note that FIG. 4A shows the speaker apparatus 1 disposed in an upright position. An arrow G indicates the direction of gravity (that is, the downward direction). In the case of FIG. 4A, the direction of gravity coincides with the axis in the up-down direction detected by the sensor 24.

Note that the sensor 24 may be a one-axis (e.g., front-back-direction-axis) acceleration sensor, or may be another sensor. They will be described in the respective embodiments.

Further, in this example, the sensor 24 is disposed in the voice coil cap 51 to detect movement of the diaphragm 3 at the corresponding driving extension, but the disposed position of the sensor 24 is not necessarily limited to this example.

In any case, the sensor 24 is only required to be mounted at a position where it can directly or indirectly detect movement at the corresponding driving point driven to vibrate by the actuator 11, 12, 13, or 14.

Here, consider circumstances of multipoint-drive speakers.

For multipoint-drive speakers, consideration has been given to, for example, the arrangement of driving points to increase the frequency at which divided vibration occurs. However, at present, sufficient measures have not been taken against variations in driving caused by speaker installation conditions or actuators.

If driving by the actuators 11, 12, 13, and 14 varies, divided vibration can occur from low frequencies, causing abnormal noise due to rolling.

With normal piston vibration, driving by the actuators 11, 12, 13, and 14 should all be uniform. If difference is caused by variations in the stiffness or compliance of suspension structural parts such as the dampers 53 and the edge 4, variations in manufacturing (such as offsets of the driving force coefficient (BL) and the diaphragm position), changes over time, etc., rolling is likely to occur.

If a rolling phenomenon occurs, not only does the sound quality deteriorate, but the voice coils 55 can rub against magnetic circuits (the yokes 57), and the boil coils 55 can break, causing the speaker to stop making sounds.

Further, if the speaker unit 2 is of a thin type, the distance between each damper 53 and the edge 4 is short, and thus the rolling phenomenon is likely to occur.

Figure 4B:
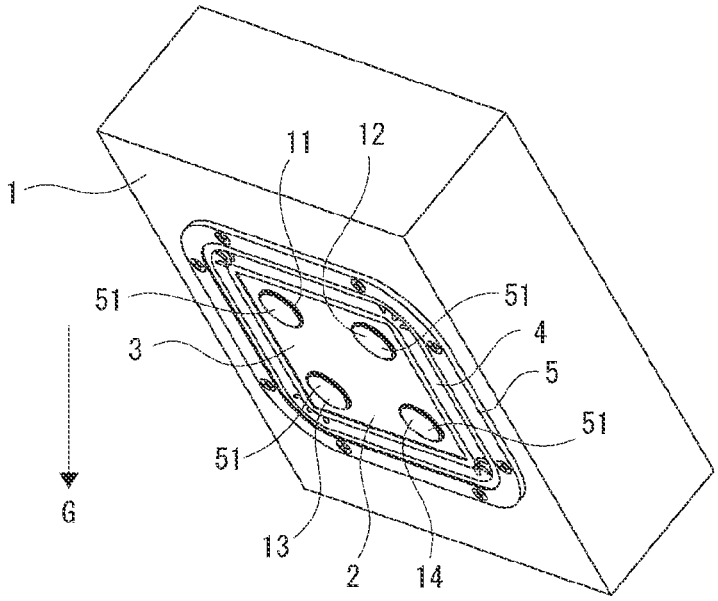

Further, FIG. 4B shows the speaker apparatus 1 disposed in an obliquely downward orientation. For example, in a case where the speaker is disposed obliquely in the corner of a room, the balance of forces applied from the driving points to the diaphragm 3 varies due to the influence of gravity. Consequently, piston vibration may not be able to be maintained, and the sound quality may be affected.

Therefore, in the present embodiment, the sensors 24 detect movements at the respective driving points, and drive signals to the actuators 11, 12, 13, and 14 are controlled on the basis of the detection results, to reduce the influence of rolling or the position on the sound quality.

2. First Embodiment

Figure 5:
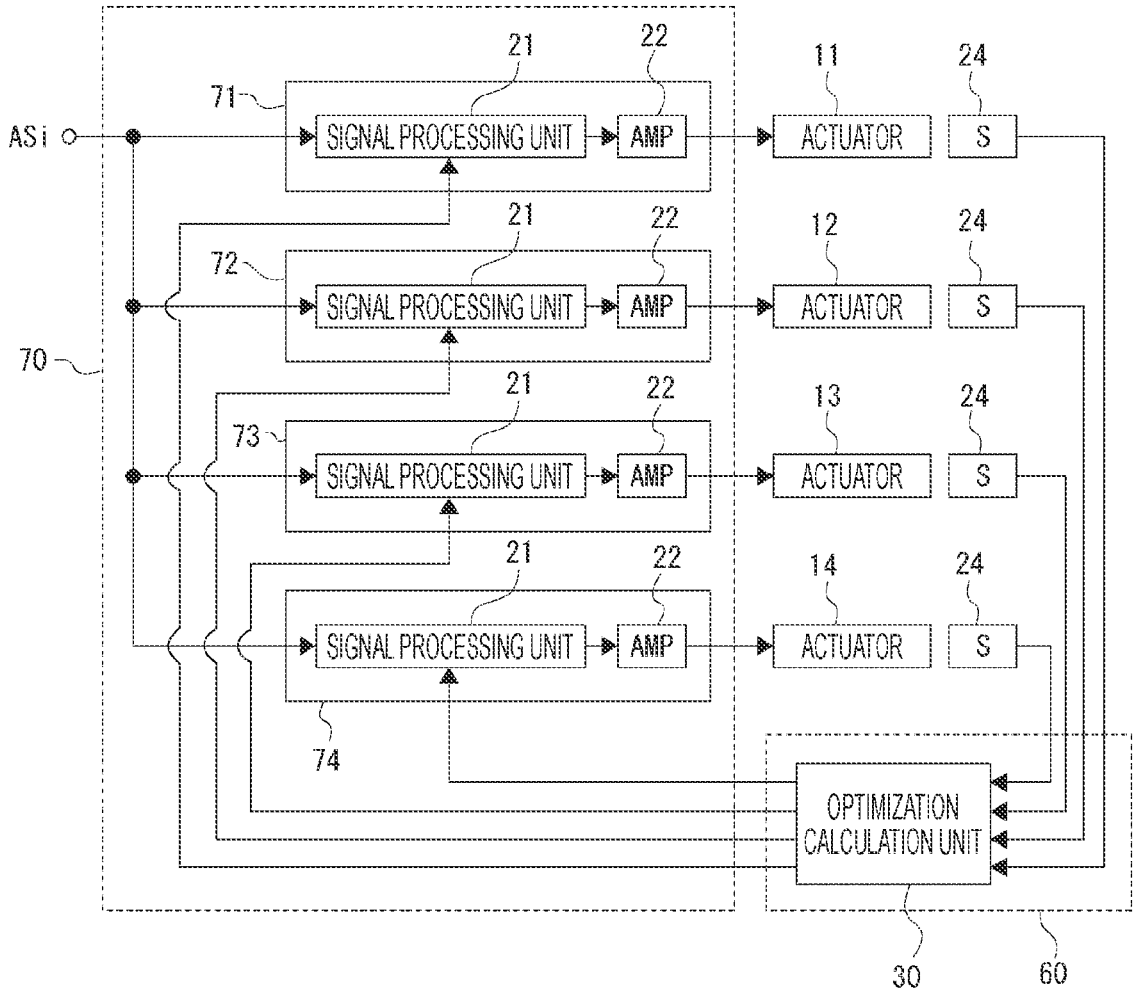
FIG. 5 is a block diagram of a configuration including a speaker drive unit according to a first embodiment.

FIG. 5 shows a configuration of a speaker drive unit as a first embodiment. This speaker drive unit is formed for the above-described speaker apparatus 1 as a multipoint-drive speaker, and is provided to the four actuators 11, 12, 13, and 14 that drive the diaphragm 3.

FIG. 5 shows, together with the actuators 11, 12, 13, and 14, a signal processing unit 70 that provides drive signals to them, and a control signal generation unit 60. The speaker drive unit of the embodiment is a device including at least the signal processing unit 70 and the control signal generation unit 60.

The sensors 24 are disposed for the corresponding actuators 11, 12, 13, and 14. In the first embodiment, each sensor 24 is, for example, a three-axis acceleration sensor.

As the signal processing unit 70, a first signal system 71, a second signal system 72, a third signal system 73, and a fourth signal system 74 are provided as circuit systems for providing drive signals to the corresponding actuators 11, 12, 13, and 14. Hereinafter, the first signal system 71, the second signal system 72, the third signal system 73, and the fourth signal system 74 are also denoted as the signal system 71, the signal system 72, the signal system 73, and the signal system 74, respectively.

The signal systems 71, 72, 73, and 74 each include a signal processing unit 21 and a power amplifier 22.

The same audio signal ASi is input to the signal systems 71, 72, 73, and 74. Then, in the signal systems 71, 72, 73, and 74, the audio signal ASi is subjected to gain processing, filtering (equalizing), etc. at the respective signal processing units 21, amplified at the respective power amplifiers 22, and provided as drive signals to the corresponding actuators 11, 12, 13, and 14. That is, the signal systems 71, 72, 73, and 74 cause drive currents to flow through the respective voice coils 55 of the actuators 11, 12, 13, and 14.

The sensors 24 detect the acceleration of vibrations produced by the corresponding actuators 11, 12, 13, and 14.

Detection signals of the sensors 24 are provided to the control signal generation unit 60. In the example of FIG. 5, an optimization calculation unit 30 is provided as the control signal generation unit 60.

The optimization calculation unit 30 generates control signals to the respective signal generation units 60 of the signal system 71, 72, 73, and 74.

For example, the optimization calculation unit 30 may compare the three-axis acceleration at the driving points obtained as detection signals, and generate gain control signals for adjusting gain so that the acceleration agrees with the average value.

The respective signal processing units 21 of the signal systems 71, 72, 73, and 74 each change gain to be applied to the audio signal ASi, on the basis of the gain control signal from the optimization calculation unit 30. That is, the gain of the drive signal is adjusted in each of the signal systems 71, 72, 73, and 74.

Here, parameters of gain processing and filtering in the signal processing units 21 are the same in an initial state. Specifically, the same drive signal based on the same audio signal should cause the actuators 11, 12, 13, and 14 to perform driving to produce vibrations of the same level or phase in the diaphragm 3.

However, if changes over time, manufacturing errors, the installation position, or the like described above causes variations in force at the driving points, torsion in a rotation direction or the like occurs instead of ideal piston vibration.

In the case of the present embodiment, in which the sensors 24 as three-axis acceleration sensors are located at the corresponding driving points, speaker installation conditions as shown in FIGS. 4A and 4B can be determined. Further, during music reproduction, a force received from each driving point and also its direction can be detected.

Thus, the optimization calculation unit 30 compares detection signals from the sensors 24, and controls driving forces so as to make the magnitudes and directions of forces at the driving points uniform. Specifically, control signals are generated such that for a driving point where the driving force is small, the drive signal gain for the corresponding actuator is increased, and for a driving point where the driving force is excessive, the drive signal gain for the corresponding actuator is decreased. The respective gains of the signal processing units 21 are controlled by the control signals, so that a stable amplitude operation of the diaphragm 3 can be obtained.

Figure 6B:
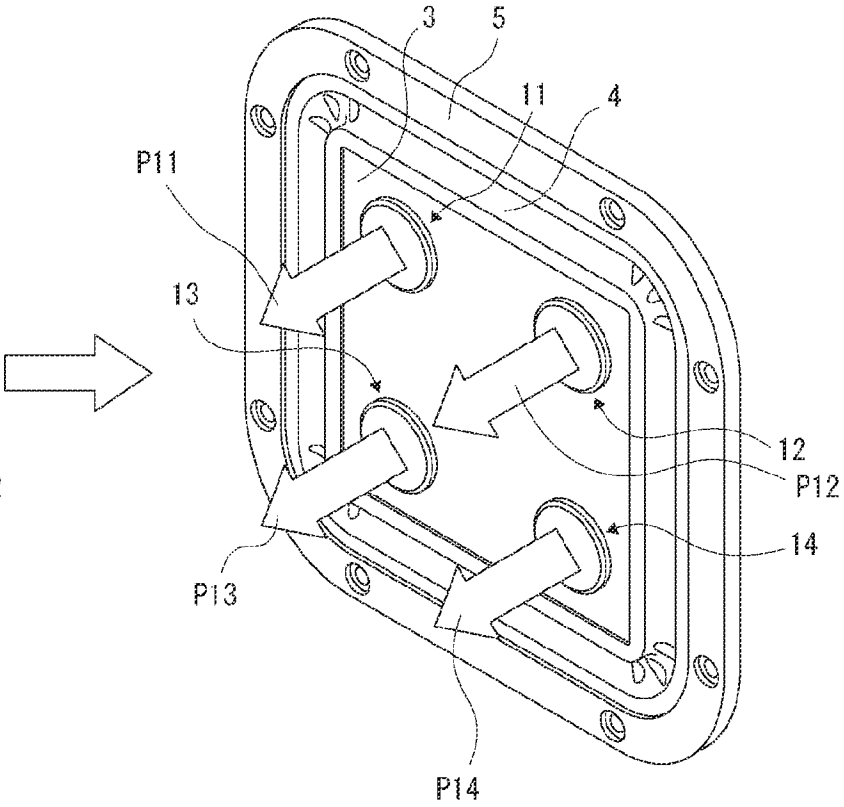
FIGS. 6A and 6B are explanatory diagrams of an improvement in vibration conditions made by control according to the embodiment.
Figure 6A:
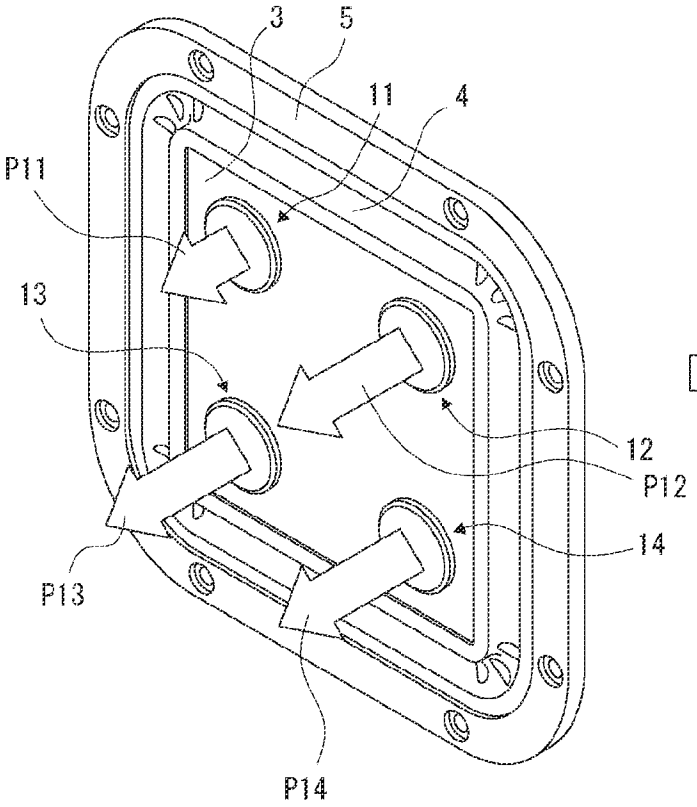

FIG. 6A schematically shows that vibration power P11 generated by the actuator 11 is smaller than vibration power P12, P13, and P14 generated by the actuators 12, 13, and 14. In a case where such conditions are detected, the optimization calculation unit 30 generates a control signal to increase the gain of the signal processing unit 21 of the signal system 71, for example.

Consequently, as schematically shown in FIG. 6B, the vibration power at the driving points can be made uniform. This can reduce or eliminate variations in force at the driving points caused by changes over time, manufacturing errors, the installation position, or the like, and can prevent rolling and resulting sound quality deterioration.

Note that equalizing control (frequency response control) may be performed to make the vibration power at the signal systems uniform on a per-frequency-band basis. This can cope with the case where vibration power characteristics vary from band to band.

Further, the generation of control signals to the signal systems 71, 72, 73, and 74 by the optimization calculation unit 30 may be appropriately performed for adjustment even during music reproduction, or may be performed at the time of speaker installation or at each activation, using an adjustment signal.

3. Second Embodiment

Figure 7:
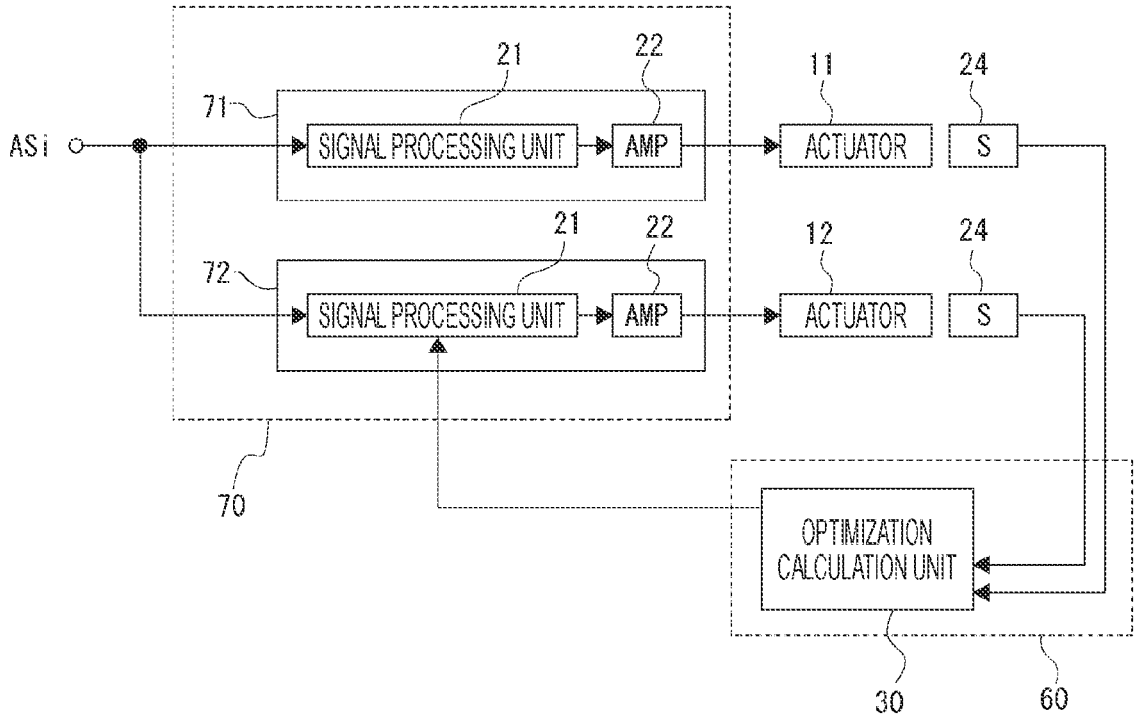
FIG. 7 is a block diagram of a configuration including a speaker drive unit according to a second embodiment.

A configuration of a speaker drive unit according to a second embodiment is shown in FIG. 7.

Note that the same reference numerals are assigned to the same parts as those in FIG. 5.

The example of FIG. 7 is a speaker drive unit of a type in which two driving points are driven by the actuators 11 and 12, and includes the signal systems 71 and 72 for the corresponding actuators 11 and 12.

In this case, the optimization calculation unit 30 generates a control signal to the signal processing unit 21 of the signal system 72 from detection signals of the sensors 24 corresponding to the actuators 11 and 12. That is, the signal processing unit 21 of the signal system 71 is not controlled.

Specifically, in this configuration, gain control is performed at the signal processing unit 21 of the signal system 72 so that the driving power at the driving point produced by the actuator 12 is made equal to the driving power at the driving point produced by the actuator 11.

For example, such a configuration is possible in which a drive signal generated by at least one signal system of a plurality of signal systems is controlled by a control signal, which can make vibration power at driving points uniform to improve sound quality.

Although not shown, it is also possible for, for example, four-point drive as in FIG. 5, that the optimization calculation unit 30 controls the signal processing units 21 of the signal systems 72, 73, and 74, thereby making the driving power at the driving points produced by the actuators 12, 13, and 14 equal to the driving power at the driving point produced by the actuator 11.

Alternatively, it is also possible to control part of the signal systems according to the arrangement of the driving points of the multipoint-drive system, the shape of the diaphragm 3, or the like, to reduce rolling or to perform control appropriate for the installation position. In these senses, various cases are expected in which gain or the like is not controlled for all of the driving points. By controlling at least one signal system, the sound quality improvement effect may be able to be obtained.

4. Third Embodiment

Figure 8:
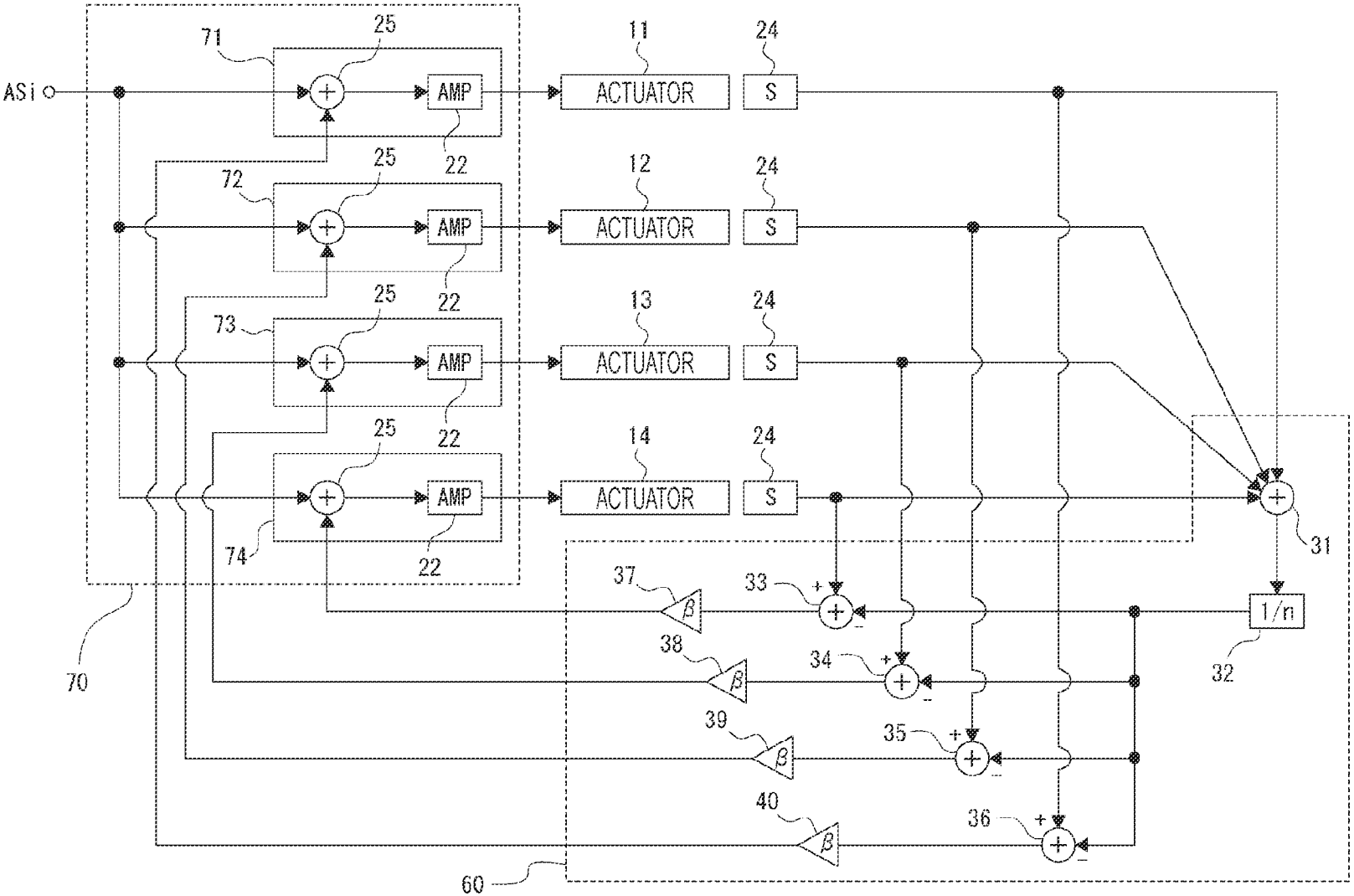
FIG. 8 is a block diagram of a configuration including a speaker drive unit according to a third embodiment.

A configuration of a speaker drive unit according to a third embodiment is shown in FIG. 8. Note that the same reference numerals are assigned to the same parts as those in FIG. 5 to avoid redundant description.

This example is, as in FIG. 5, an example in which the four-point-drive speaker unit 2 is used, and the signal systems 71, 72, 73, and 74 are provided for the corresponding actuators 11, 12, 13, and 14.

In FIG. 8, the signal systems 71, 72, 73, and 74 each include an adder 25 and a power amplifier 22.

Further, the control signal generation unit 60 is configured to output signals to be added to an audio signal as control signals to the respective adders 25 of the signal systems 71, 72, 73, and 74.

That is, in each of the signal systems 71, 72, 73, and 74, the audio signal ASi and the signal from the control signal generation unit 60 are added by the adder 25, and a drive signal amplified by the power amplifier 22 is provided to the actuator 11, 12, 13, or 14.

The sensors 24 corresponding to the actuators 11, 12, 13, and 14 are, for example, one-axis (front-back-direction-axis) acceleration sensors.

The control signal generation unit 60 includes an adder 31, an averaging operation unit 32, subtractors 33, 34, 35, and 36, and gain amplifiers 37, 38, 39, and 40.

In the control signal generation unit 60, first, the adder 31 adds detection signals from the sensors 24 (values corresponding to the acceleration in the front-rear direction). The added value is provided to the averaging operation unit 32, which performs an operation of 1/n. n is the number of driving points (the number of actuators). In this case, an operation of quartering the added value is performed, whereby the average value of the detection signals from the sensors 24 is determined. The average value is provided to the subtractors 33, 34, 35, and 36.

The subtractor 36 subtracts the average value from the detection signal of the sensor 24 corresponding to the actuator 11. The gain amplifier 40 multiplies the difference value from the average value by β. This is provided to the adder 25 of the signal system 71 as a control signal.

The subtractor 35 subtracts the average value from the detection signal of the sensor 24 corresponding to the actuator 12. The gain amplifier 39 multiplies the difference value from the average value by β. This is provided to the adder 25 of the signal system 72 as a control signal.

The subtractor 34 subtracts the average value from the detection signal of the sensor 24 corresponding to the actuator 13. The gain amplifier 38 multiplies the difference value from the average value by β. This is provided to the adder 25 of the signal system 73 as a control signal.

The subtractor 33 subtracts the average value from the detection signal of the sensor 24 corresponding to the actuator 14. The gain amplifier 37 multiplies the difference value from the average value by β. This is provided to the adder 25 of the signal system 74 as a control signal.

That is, this configuration applies acceleration feedback MFB. For each of the actuators 11, 12, 13, and 14, acceleration negative feedback is applied if the acceleration produced by the actuator is larger than the average acceleration of all the actuators 11, 12, 13, and 14, and acceleration positive feedback is applied if it is smaller than the average.

By this operation, acceleration feedback is applied in a way that makes all the actuators uniform in acceleration.

This operation to make all the actuators 11, 12, 13, and 14 uniform in acceleration can correct variations in driving by the actuators 11, 12, 13, and 14, preventing the rolling phenomenon in the diaphragm 3.

By preventing the rolling phenomenon, the quality of sound output from the speaker can be improved. In addition, breaking due to contact between the voice coils 55 and the magnetic circuits can be prevented to improve reliability.

5. Fourth Embodiment

Figure 9:
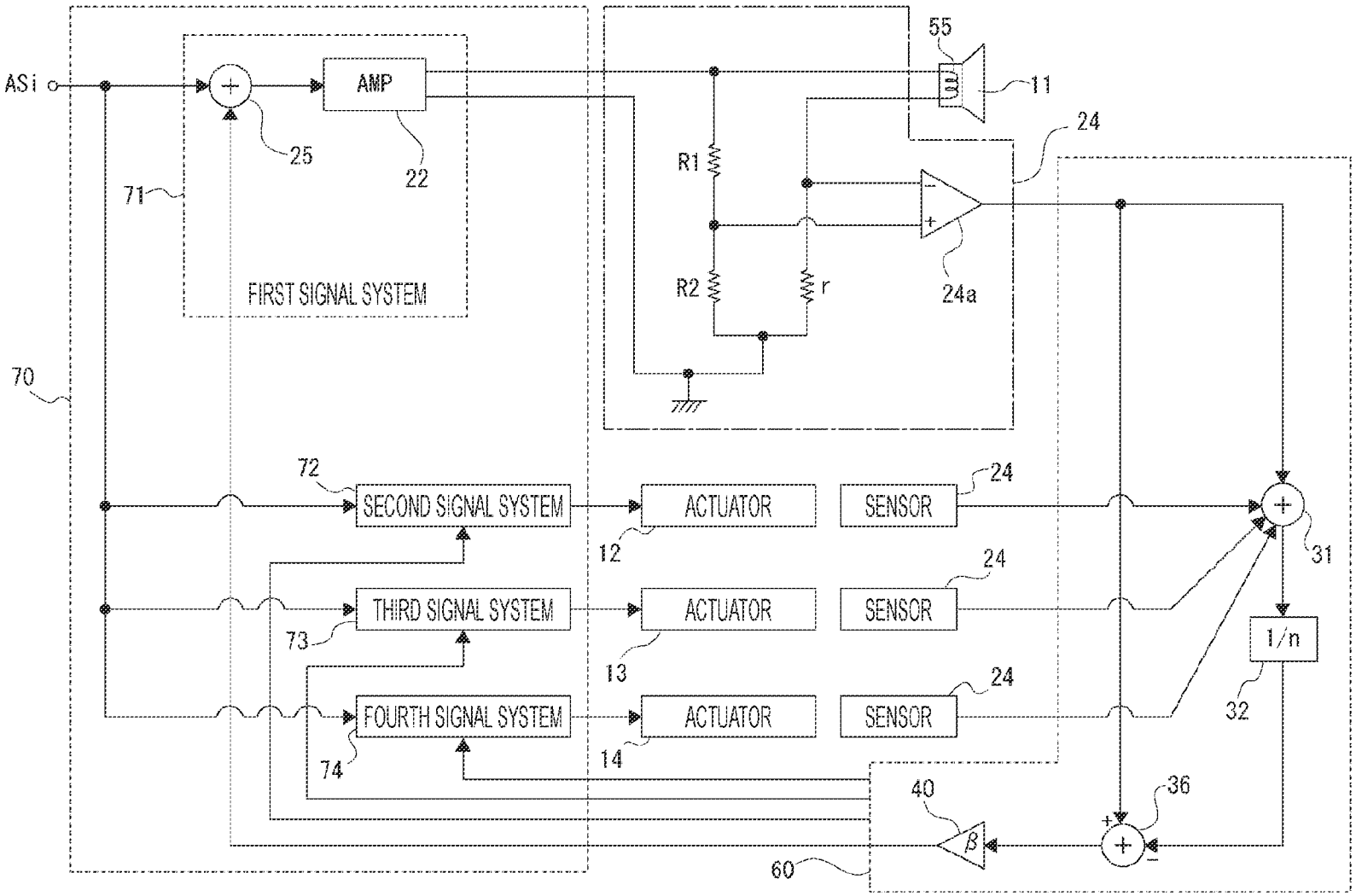
FIG. 9 is a block diagram of a configuration including a speaker drive unit according to a fourth embodiment.

A configuration of a speaker drive unit according to a fourth embodiment is shown in FIG. 9.

Note that FIG. 9 shows another example of the configuration of each sensor 24, and the other configurations are similar to those in FIG. 8. However, for convenience of illustration, the signal systems 72, 73, and 74 and the actuators 12, 13, and 14 are simply shown. Further, for the control signal generation unit 60, only a part corresponding to the signal system 71 is shown, but, as in FIG. 8, it includes the adder 31, the averaging operation unit 32, the subtractors 33, 34, 35, and 36, and the gain amplifiers 37, 38, 39, and 40.

In the example of FIG. 9, each sensor 24 is an MFB bridge circuit. The negative electrode side of the voice coil 55 of the actuator 11 is connected to a ground via a resistor r. Further, resistors R1 and R2 are connected in series between the positive electrode side of the voice coil 55 and the ground. Then, a connection point between the resistors R1 and R2 is connected to the non-inverting input terminal of a differential amplifier 24*a*, and the negative electrode side of the voice coil 55 is connected to the inverting input terminal of the differential amplifier 24*a*.

An output of the differential amplifier 24*a* is a detection signal corresponding to a driving speed produced by the actuator 11.

The sensors 24 corresponding to the other actuators 12, 13, and 14 are similarly configured.

Then, detection signals of them are provided to the control signal generation unit 60.

The control signal generation unit 60 calculates the average value of the detection signals from the sensors 24, using the adder 31 and the averaging operation unit 32. Then, the control signal generation unit 60 generates control signals, using the subtractors 36 (and 35, 34, and 33) and the gain amplifiers 40 (and 39, 38, and 37), and provides them to the adders 25 of the signal systems 71 (and 72, 73, and 74).

Such a configuration can also provide effects similar to those of the third embodiment.

6. Fifth Embodiment

Figure 10:
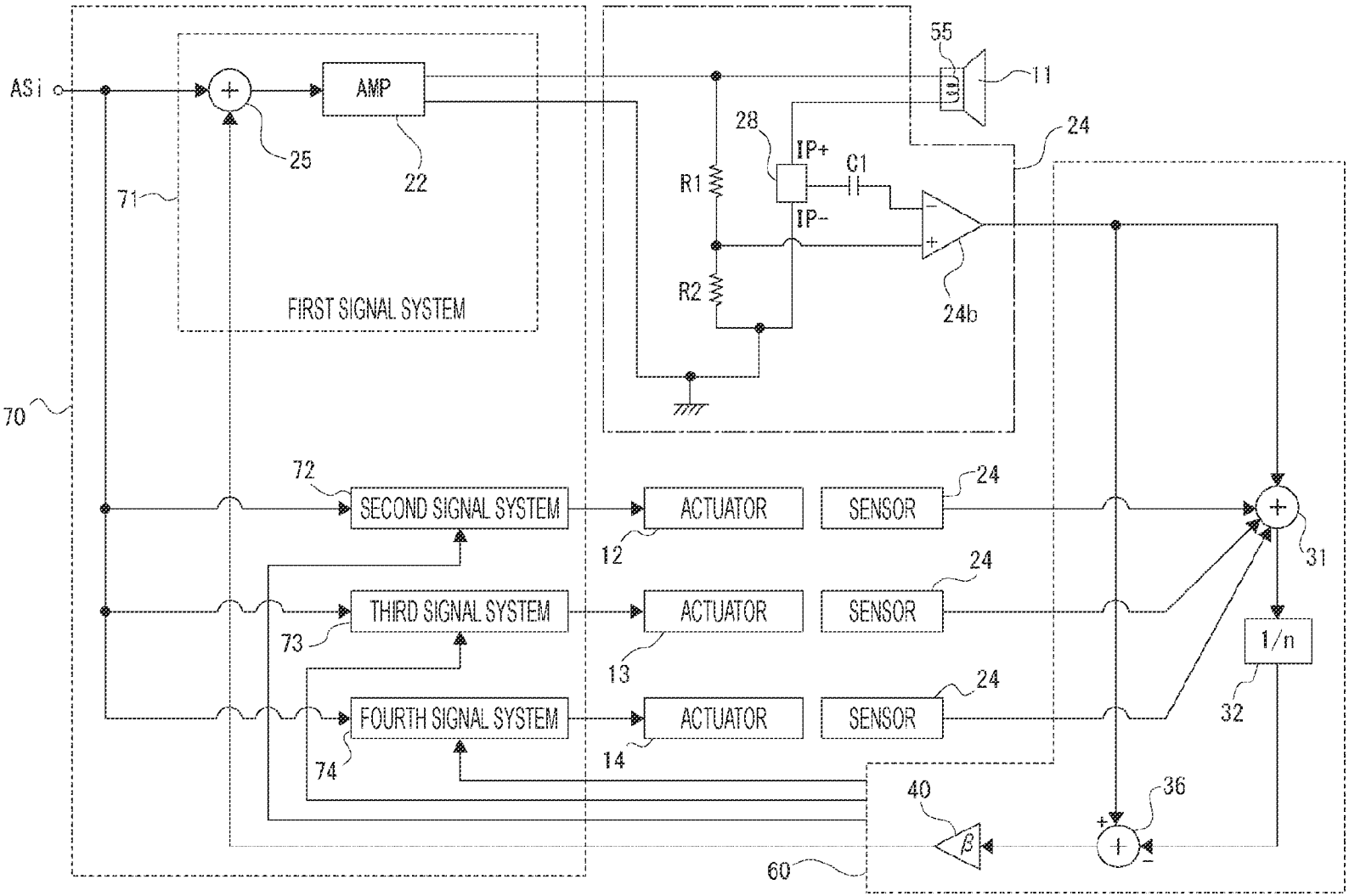
FIG. 10 is a block diagram of a configuration including a speaker drive unit according to a fifth embodiment.

A configuration of a speaker drive unit according to a fifth embodiment is shown in FIG. 10.

FIG. 10 also shows another example of the configuration of each sensors 24. The other configurations are similar to those in FIG. 8 and are simply shown as in FIG. 9.

In the example of FIG. 10, each sensor 24 is configured as a current detection circuit using a Hall element 28. The negative electrode side of the voice coil 55 of the actuator 11 is connected to a ground via the Hall element 28. Further, resistors R1 and R2 are connected in series between the positive electrode side of the voice coil 55 and the ground. Then, a connection point between the resistors R1 and R2 is connected to the non-inverting input terminal of a differential amplifier 24*b*, and the output of the Hall element 28 is connected to the inverting input terminal of the differential amplifier 24*b* via a capacitor C1.

An output of the differential amplifier 24*b* is a detection signal corresponding to the driving speed produced by the actuator 11.

The sensors 24 corresponding to the other actuators 12, 13, and 14 are similarly configured.

Then, detection signals of them are provided to the control signal generation unit 60.

The control signal generation unit 60 calculates the average value of the detection signals from the sensors 24, using the adder 31 and the averaging operation unit 32. Then, the control signal generation unit 60 generates control signals, using the subtractors 36 (and 35, 34, and 33) and the gain amplifiers 40 (and 39, 38, and 37), and provides them to the adders 25 of the signal systems 71 (and 72, 73, and 74).

Such a configuration can also provide effects similar to those of the third embodiment.

7. Applicable Speaker Examples

The above embodiments use the multipoint-drive speaker having, for example, four driving points as an example, but the technology of the above-described speaker drive unit is also applicable to other speaker configurations.

Figure 11:
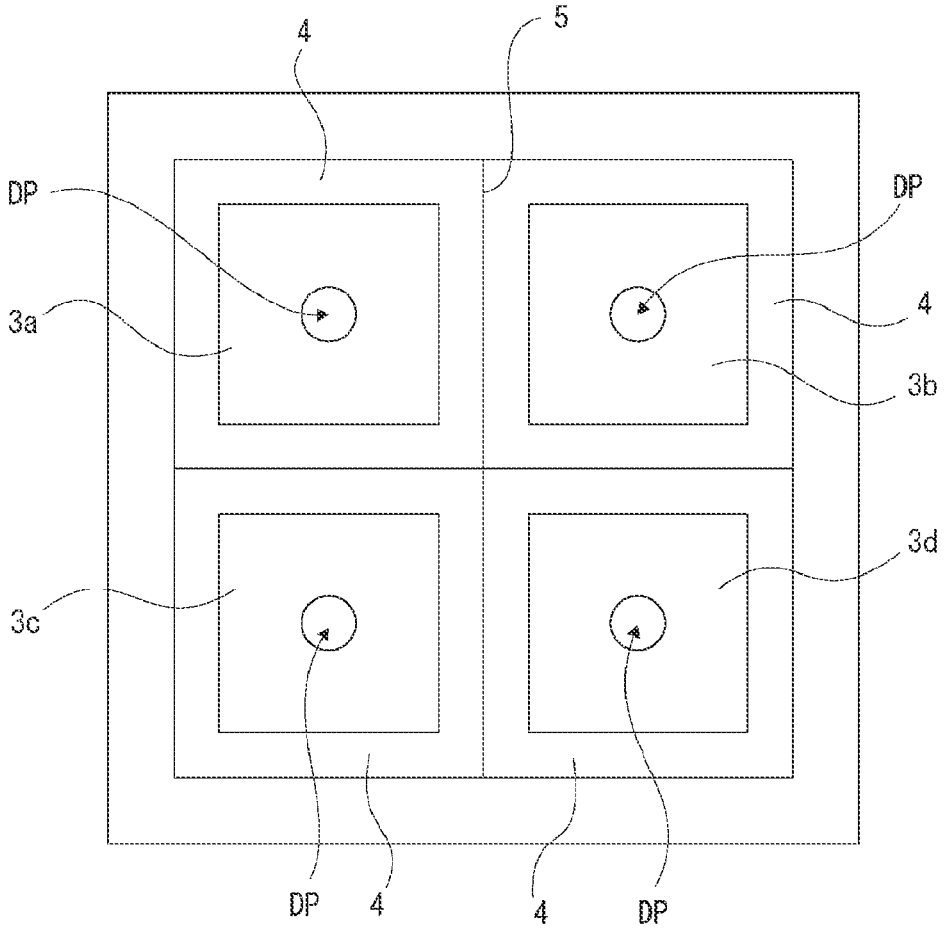
FIG. 11 is an explanatory diagram of an example of application of the embodiments.

FIG. 11 shows a speaker apparatus in which four diaphragms 3*a*, 3*b*, 3*c*, and 3*d* are each driven at one driving point DP.

In this case, each of the diaphragms 3*a*, 3*b*, 3*c*, and 3*d* is driven by one actuator. The actuators of the diaphragms 3*a*, 3*b*, 3*c*, and 3*d* are given drive signals based on the same audio signal. Therefore, the configuration of the speaker drive unit includes the four signal systems 71, 72, 73, and 74 as in FIG. 5, for example.

In this configuration, the sensors 24 corresponding to the driving points DP are disposed. By adopting the configuration as in FIG. 5, 8, 9, or 10, for example, it can also be used to move the plurality of independent diaphragms 3*a*, 3*b*, 3*c*, and 3*d* in phase.

Figure 12:
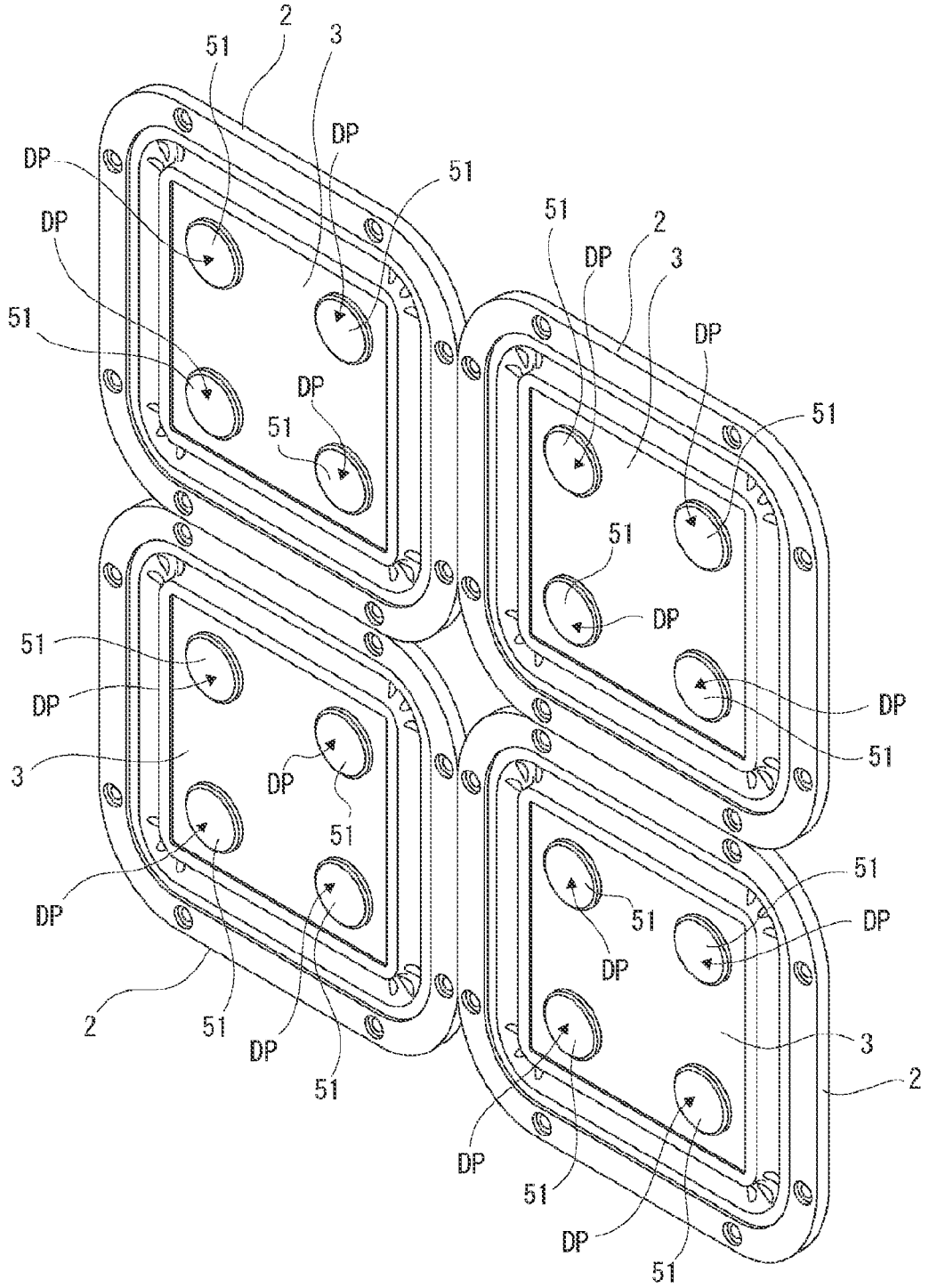
FIG. 12 is an explanatory diagram of an example of application of the embodiments.

FIG. 12 is an example of a speaker apparatus in which four multipoint-drive speaker units 2, each of which has been described with reference to FIGS. 2 and 3, are placed side by side and driven in phase.

This configuration is for increasing volume, for example. Not only in each speaker unit 2, driving points DP are made uniform in amplitude and phase, but among the four speaker units 2, the driving points DP are made uniform in amplitude and phase. This allows a plurality of multipoint-drive speakers to be treated as one large speaker, and to be synchronized with each other for in-phase reproduction, to be usable for reproduction expansion such as increasing sound pressure.

8. Display Device Configuration

The speaker drive unit of the present embodiment can be applied to, for example, a speaker with a display surface of a display device as a diaphragm.

A configuration in which an image display surface 110A of a display device 100 is used as an excitation unit 120 will be described with reference to FIGS. 13 to 16.

Figure 13:
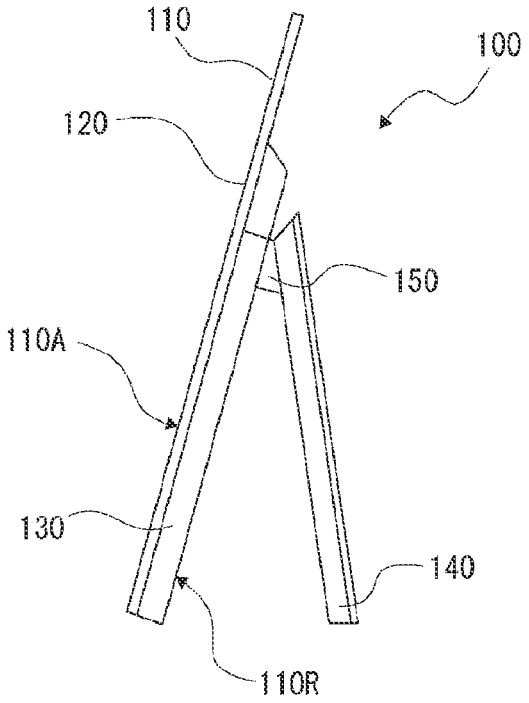
FIG. 13 is an explanatory diagram of a side configuration of a display device to which the present technology can be applied.
Figure 14:
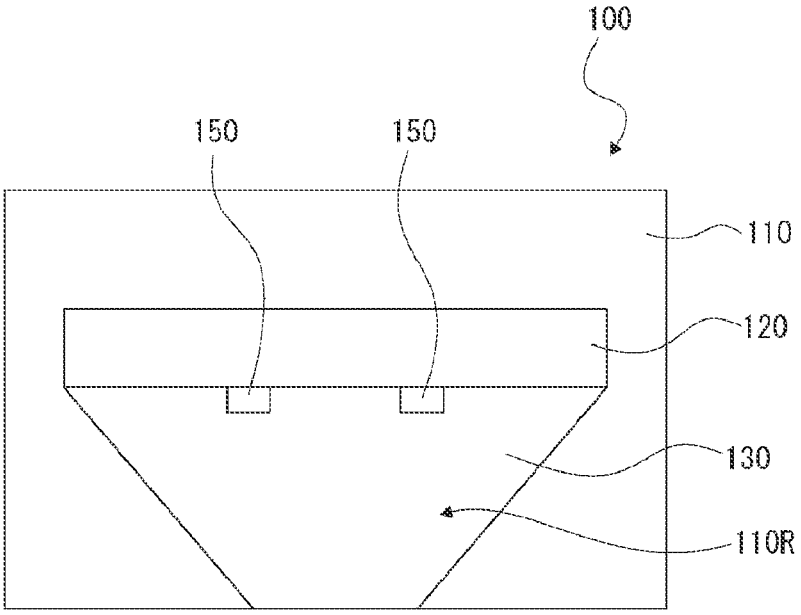
FIG. 14 is an explanatory diagram of a rear configuration of the display device to which the present technology can be applied.

FIG. 13 shows an example of a side configuration of the display device 100. FIG. 14 shows an example of a rear configuration of the display device 100 in FIG. 13. The display device 100 displays images on the image display surface 110A and outputs sounds from the image display surface 110A. In other words, the display device 100 can be said to have a flat panel speaker built in the image display surface 110A.

The display device 100 includes, for example, a panel 110 that displays images and also functions as a diaphragm, and an excitation unit 120 that is disposed on the rear surface of the panel 110 to vibrate the panel 110. The display device 100 further includes, for example, a signal processing unit 130 that controls the excitation unit 120, and a support 140 that supports the panel 110 via rotating parts 150. The rotating parts 150 are for adjusting the inclination angle of the panel 110 when the rear surface of the panel 110 is supported by the support 140, and are, for example, hinges that rotatably support the panel 110 and the support 140.

The excitation unit 120 and the signal processing unit 130 are disposed at the rear surface of the panel 110. The panel 110 has a rear cover 110R on the rear side of the panel 110 to protect the panel 110, the excitation unit 120, and the signal processing unit 130. The rear cover 110R is made from, for example, a plate-shaped metal plate or resin plate. The rear cover 110R is coupled to the rotating parts 150.

Figure 15:
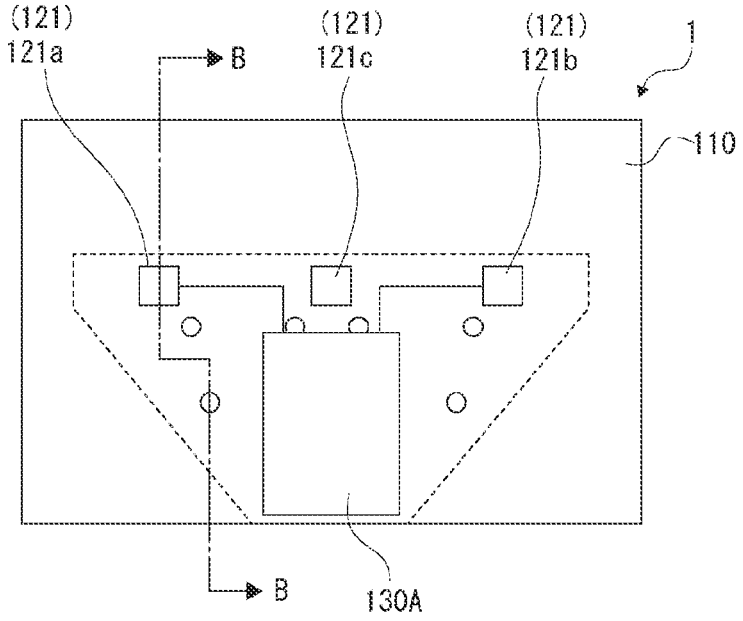
FIG. 15 is an explanatory diagram of the rear configuration of the display device with a rear cover removed, to which the present technology can be applied.
Figure 16:
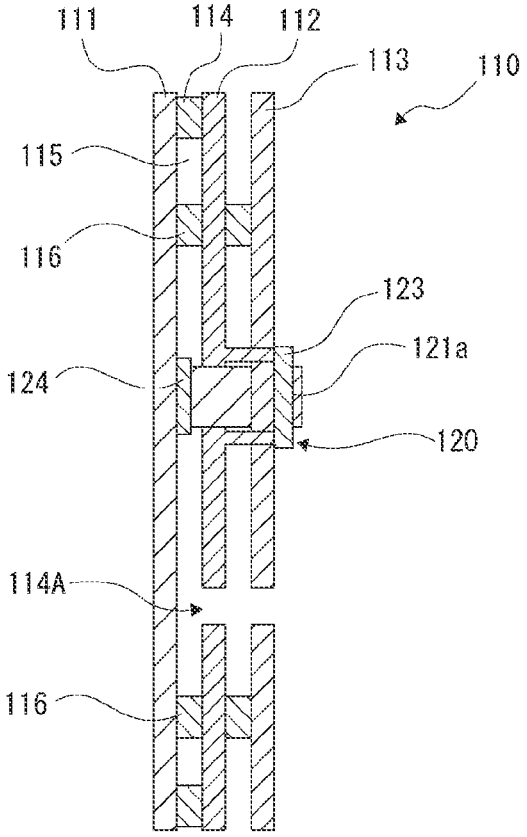
FIG. 16 is a B-B cross-sectional view of the display device to which the present technology can be applied.

FIG. 15 shows a configuration example of the rear surface of the display device 100 when the rear cover 110R is removed. A circuit board 130A corresponds to a specific example of the signal processing unit 130. FIG. 16 shows an example of a cross-sectional configuration along line B-B in FIG. 15. FIG. 16 illustrates a cross-sectional configuration of an exciter 121*a* (actuator) described later. This cross-sectional configuration is similar to the cross-sectional configuration of other exciters (e.g., exciters 121*b* and 121*c* (actuators)).

The panel 110 includes, for example, a thin plate-shaped display cell 111 for displaying images, an inner plate 112 (opposing plate) disposed opposite the display cell 111 with a space 115 therebetween, and a back chassis 113. The inner plate 112 and the back chassis 113 may be combined in one piece. The surface of the display cell 111 (the surface opposite to the excitation unit 120) is the image display surface 110A. The panel 110 further includes, for example, a fixing member 114 between the display cell 111 and the inner plate 112.

The fixing member 114 has a function of fixing the display cell 111 and the inner plate 112 to each other, and a function as a spacer for maintaining the space 115. The fixing member 114 is disposed, for example, along the outer edge of the display cell 111. The fixing member 114 may have flexibility enough for the edge of the display cell 111 to behave as a free end when the display cell 111 is vibrating, for example. The fixing member 114 is made from, for example, a sponge having adhesive layers on both sides.

The inner plate 112 is a base plate supporting the exciters 121 (121*a*, 121*b*, and 121*c*). The inner plate 112 has, for example, openings at places where the exciters 121*a*, 121*b*, and 121*c* are installed (hereinafter referred to as the "openings for the exciters"). The inner plate 112 further has, for example, one or more openings (hereinafter referred to as "air holes 114A") in addition to the openings for the exciters. The one or more air holes 114A function as air holes that reduce variations in the air pressure occurring in the space 115 when the display cell 111 is vibrated by the vibration of the exciters 121*a*, 121*b*, and 121*c*. The one or more air holes 114A are formed away from the fixing member 111 so as not to overlap the fixing member 114 and vibration damping members 116 described later.

The one or more air holes 114A have, for example, a cylindrical shape. The one or more air holes 114A may have, for example, a square tube shape. The inner diameter of the one or more air holes 114A is, for example, about some centimeters. Note that one air hole 114A may include a number of small-diameter through holes as long as it functions as an air hole.

The back chassis 113 has a higher rigidity than the inner plate 112, and has a function of reducing bending or vibration of the inner plate 112. The back chassis 113 has, for example, openings at positions opposite to the openings of the inner plate 112 (e.g., the openings for the exciters and the air holes 114A). Of the openings provided in the back chassis 113, the openings provided at the positions opposite to the openings for the exciters have a size enough to insert the exciters 121*a*, 121*b*, and 121*c*. Of the openings provided in the back chassis 113, the openings provided at the positions opposite to the air holes 114A function as air holes that reduce variations in the air pressure occurring in the space 115 when the display cell 111 is vibrated by the vibration of the exciters 121*a*, 121*b*, and 121*c*.

The back chassis 113 is made from, for example, a glass substrate. Note that instead of the back chassis 113, a metal substrate or a resin substrate having the same rigidity as the back chassis 113 may be provided.

The excitation unit 120 includes, for example, the three exciters 121*a*, 121*b*, and 121*c*. The exciters 121*a*, 121*b*, and 121*c* have the same configuration.

The exciters 121*a*, 121*b*, and 121*c* are arranged, for example, in a row in the left-right direction at a height position slightly above the center of the display cell 111 in the up-down direction.

Each of the exciters 121*a*, 121*b*, and 121*c* is, for example, a speaker actuator that includes a voice coil, a voice coil bobbin, and a magnetic circuit, and serves as a vibration source.

The exciters 121*a,* 121*b,* and 121*c* each produce a driving force in the voice coil according to the principle of electromagnetic action when an audio current of an electrical signal flows through the voice coil. The driving force is transmitted to the display cell 111 via a vibration transmission member 124, producing vibrations corresponding to variations in the audio current in the display cell 111, so that the air vibrates and the sound pressure varies.

A fixing part 123 and the vibration transmission member 124 are provided to each of the exciters 121*a,* 121*b,* and 121*c.*

The fixing part 123 has, for example, an opening for fixing the exciter 121*a,* 121*b,* or 121*c* inserted therethrough. The exciters 121*a,* 121*b,* and 121*c* are, for example, fixed to the inner plate 112 via the respective fixing parts 123.

The vibration transmission members 124 are, for example, in contact with the rear surface of the display cell 111 and the bobbins of the exciters 121*a,* 121*b,* and 121*c,* and are fixed to the rear surface of the display cell 111 and the bobbins of the exciters 121*a,* 121*b,* and 121*c.* The vibration transmission members 124 are members having repelling properties at least in the sound wave range (20 Hz or more).

As shown in FIG. 16, for example, the panel 110 has the vibration damping members 116 between the display cell 111 and the inner plate 112. The vibration damping members 116 have an action of preventing vibrations produced in the display cell 111 by the exciters 121*a,* 121*b,* and 121*c* from interfering with each other.

The vibration damping members 116 are disposed in the gap between the display cell 111 and the inner plate 112, that is, in the space 115. The vibration damping members 116 are fixed to, of the rear surface of the display cell 111 and the front surface of the inner plate 112, at least the rear surface of the display cell 111. The vibration damping members 116 are, for example, in contact with the front surface of the inner plate 112.

For example, in the display device 1 of the above configuration, one diaphragm, that is, the display cell 111 is vibrated by three actuators as the exciters 121*a,* 121*b,* and 121*c.*

In the display device 1 like this, the configurations described in the first to fifth embodiments described above can be applied as a speaker drive unit corresponding to the exciters 121*a,* 121*b,* and 121*c.*

9. Summary and Modifications

According to the above embodiments, the following effects can be obtained.

The speaker drive unit of the embodiments includes the control signal generation unit 60 that generates a control signal on the basis of detection signals generated by a plurality of detection units (sensors 24) that is disposed in one-to-one correspondence with the plurality of actuators 11, 12, 13, and 14 that vibrates the diaphragm 3, and detects vibration conditions, and the signal processing unit 70 that includes the plurality of signal systems 71, 72, 73, and 74 in one-to-one correspondence with the plurality of actuators, the signal systems 71, 72, 73, and 74 providing a drive signal to the corresponding actuators 11, 12, 13, and 14 on the basis of the same audio signal ASi, the drive signal generated by at least one signal system of the signal systems 71, 72, 73, and 74 being controlled by the control signal.

That is, all or part of the drive signals to the plurality of actuators 11, 12, 13, and 14 that drives the diaphragm 3 of the speaker unit 2 is/are controlled by the control signal(s) based on the detection signals from the sensors 24.

This enables control of vibrations of the diaphragm produced by the plurality of actuators for the output of the same sound.

Consequently, for example, regardless of speaker installation conditions, stable piston vibration can be achieved, and good sound quality can be obtained.

Further, even if the actuators 11, 12, 13, and 14 produce different amplitudes due to variations in manufacturing, variations in material, differences due to changes over time, or the like, these can be made uniform to obtain good sound quality.

Further, as described in the second embodiment, by controlling at least one signal system of the plurality of systems in the signal processing unit 70, vibrations produced by the plurality of actuators can also be made uniform (vibration levels and phases can be made uniform) to prevent rolling, to achieve good sound reproduction.

Further, by preventing rolling, the possibility of breaking of the voice coils 55 or the like can be significantly reduced to achieve a more reliable speaker apparatus.

In the first, third, fourth, and fifth embodiments, an example has been described in which the control signal generation unit 60 generates a control signal to each of the plurality of signal systems 71, 72, 73, and 74, and in the signal processing unit 70, a drive signal of each of the plurality of signal systems 71, 72, 73, and 74 is controlled by the control signal.

This enables control of vibrations of the diaphragm 3 produced by each of the actuators 11, 12, 13, and 14, so that vibrations produced by each of the actuators 11, 12, 13, and 14 can be controlled to a desirable vibration condition, individually.

This allows uniform vibration, prevention of rolling, stable piston vibration, etc.

In the embodiments, it has been described that the control signal generation unit 60 generates control signals to make the detection signals of the plurality of sensors 24 uniform.

That is, the control signal generation unit 60 generates control signals to control the drive signals so as to eliminate differences between the detection signals.

This enables feedback control to make the vibration levels and the vibration phases in the diaphragm 3 produced by the actuators 11, 12, 13, and 14 uniform, achieving an improvement in sound quality.

In the first and second embodiments, an example has been described in which a control signal is a signal for gain control of a drive signal in all or part of the signal systems of the signal processing unit 70.

By controlling gain given to a drive signal in all or part of the signal systems 71, 72, 73, and 74, the vibration levels in the diaphragm can be made uniform. This allows diaphragm driving suitable for a multipoint-drive speaker.

In the first and second embodiments, an example has been described in which a control signal is a signal for controlling the frequency response of a drive signal in all or part of the signal systems of the signal processing unit 70.

By adjusting the frequency response of a drive signal in all or part of the signal systems 71, 72, 73, and 74, vibrations of the diaphragm produced by the actuators can be adjusted, and diaphragm driving suitable for a multipoint-drive speaker can be achieved.

In the third embodiment, an example has been described in which the control signal generation unit 60 generates control signals for feedback control using acceleration detection signals on vibrations produced by the actuators 11, 12, 13, and 14.

This allows vibration control to be performed by an MFB configuration using acceleration feedback, to improve sound quality of the speaker.

In the third, fourth, and fifth embodiments, an example has been described in which the control signal generation unit 60 determines the average value of detection signals of the plurality of sensors 24, and generates control signals using the average value.

Specifically, as in the third embodiment, for each of the signal systems 71, 72, 73, and 74, a difference from the average value is determined for the detection signal of the corresponding sensor 24, and a control signal based on the difference is generated to apply MFB.

Thus, negative feedback is applied to an actuator whose acceleration is higher than the average, to work in a way that decreases the acceleration, and conversely, positive feedback is applied to an actuator whose acceleration is lower than the average. This allows operation to make the acceleration of all the actuators uniform, correcting variations in the actuators to prevent the rolling phenomenon in the diaphragm 3. By preventing the rolling phenomenon, the sound quality of the speaker can be improved, breaking caused by contact between the voice coils 55 and the magnetic circuits can be prevented, and reliability can be improved.

The plurality of actuators 11, 12, 13, and 14 described in the embodiments is actuators that drive the same diaphragm 3. That is, an example of actuators of a multipoint-drive speaker unit has been described.

As a speaker drive unit for such a multipoint-drive speaker unit, the control signal generation unit 60 and the signal processing unit 70 are used, so that driving variations caused by the actuators 11, 12, 13, and 14 can be eliminated for the single diaphragm 3, allowing the multipoint-drive speaker unit to perform properly.

For example, as in the embodiments, in a speaker in which a planar diaphragm is moved by multipoint drive drivers, by disposing an acceleration sensor at each driving point to detect influence by manufacturing variations, changes over time, and speaker installation conditions, etc., to control force applied to each actuator, stable piston vibration can be achieved, and good sound quality can be obtained.

In the embodiments, an example has also been described with reference to FIGS. 11 and 12, in which a plurality of actuators is actuators each or each part of which drives a corresponding different diaphragm.

That is, in a system that reproduces sounds by a combination of a plurality of speaker units, each actuator is an actuator of the corresponding speaker unit.

Alternatively, in a speaker unit having a plurality of independent diaphragms, each actuator is an actuator for the corresponding diaphragm.

In a case where a plurality of independent diaphragms is moved in phase as in the example of FIG. 11, or in a case where a plurality of multipoint-drive speakers is synchronized for in-phase reproduction to increase the sound pressure as in the example of FIG. 12, or the like, the control signal generation unit 60 and the signal processing unit 70 being used as a speaker drive unit allow the diaphragms to vibrate uniformly, effectively increasing the volume and improving the sound quality.

In the embodiments, a configuration has been described with reference to FIGS. 13 to 16, in which a plurality of actuators (the exciters 121*a*, 121*b*, and 121*c*) uses an image display panel (the display cell 111) as a diaphragm.

In a case where a device that outputs sounds by actuators vibrating an image display panel like this is considered, by the control signal generation unit 60 and the signal processing unit 70 being used as a speaker drive unit for the plurality of actuators (the exciters 121*a*, 121*b*, and 121*c*) that vibrates the image display panel, the image display panel can be properly vibrated to effectively improve the sound quality.

In the embodiments, acceleration sensors have been described as an example of the detection units (sensors 24).

That is, the control signal generation unit 60 generates control signals for controlling drive signals of the actuators 11, 12, 13, and 14 on the basis of acceleration detection signals as signals indicating the vibration conditions of the diaphragm 3. In this case, control is performed to make the acceleration of vibrations of the diaphragm uniform. This can make the amplitude levels and phases of vibrations uniform to achieve an improvement in sound quality. Note that the acceleration sensors may be one-axis, two-axis, or three-axis ones.

Further, as an example of the sensors 24, drive current detection units for the actuators have been described.

That is, the control signal generation unit 60 obtains detection signals of drive currents of the actuators as signals indicating the vibration conditions of the diaphragm 3, and generates control signals for controlling the respective drive signals of the actuators on the basis of the detection signals. That is, in place of the acceleration sensors, current sensors may be used as in FIG. 10.

Further, as an example of the sensors 24, bridge circuits provided in drive signal paths for the actuators have been described. For example, they are MFB bridge circuits. In place of the acceleration sensors, MFB bridge circuits may be used as in FIG. 9.

Note that the effects described in the present description are merely examples and nonlimiting, and other effects may be included.

Note that the present technology can also have the following configurations.

(1)

A speaker drive unit including:

a control signal generation unit that generates a control signal on the basis of detection signals generated by a plurality of detection units that is disposed in one-to-one correspondence with a plurality of actuators that vibrates a diaphragm, and detects vibration conditions; and a signal processing unit that includes a plurality of signal systems corresponding one-to-one to the plurality of actuators, the signal systems providing a drive signal to the corresponding actuators on the basis of the same audio signal, the drive signal generated by at least one signal system of the signal systems being controlled by the control signal.

(2)

The speaker drive unit according to (1) above, in which the control signal generation unit generates a control signal to each of the plurality of signal systems, and the drive signal of each of the plurality of signal systems is controlled by the control signal in the signal processing unit.

(3)

The speaker drive unit according to (1) or (2) above, in which the control signal generation unit generates a control signal to make the detection signals of the plurality of detection units uniform.

(4)

The speaker drive unit according to any one of (1) to (3) above, in which the control signal is a signal to control gain of the drive signal of the signal system.

(5)

The speaker drive unit according to any one of (1) to (4) above, in which the control signal is a signal to control frequency response of the drive signal of the signal system.

(6)

The speaker drive unit according to any one of (1) to (3) above, in which the control signal generation unit generates a control signal for feedback control using detection signals of acceleration of vibrations produced by the actuators.

(7)

The speaker drive unit according to any one of (1) to (6) above, in which the control signal generation unit determines an average value of the detection signals of the plurality of detection units, and generates a control signal using the average value.

(8)

The speaker drive unit according to any one of (1) to (7) above, in which the plurality of actuators is actuators that drive the same diaphragm.

(9)

The speaker drive unit according to any one of (1) to (7) above, in which the plurality of actuators is actuators each or each part of which drives a different diaphragm.

(10)

The speaker drive unit according to any one of (1) to (9) above, in which the plurality of actuators is actuators that vibrate an image display panel in a configuration in which the image display panel is used as a diaphragm.

(11)

The speaker drive unit according to any one of (1) to (10) above, in which the detection units are acceleration detection units.

(12)

The speaker drive unit according to any one of (1) to (10) above, in which the detection units are drive current detection units for the actuators.

(13)

The speaker drive unit according to any one of (1) to (10) above, in which the detection units include bridge circuits provided in drive signal paths for the actuators.

(14)

A speaker apparatus including:

a diaphragm;

a plurality of actuators that vibrates the diaphragm;

a plurality of detection units that is disposed in one-to-one correspondence with the plurality of actuators, and detects vibration conditions;

a control signal generation unit that generates a control signal on the basis of detection signals generated by the plurality of detection units; and a signal processing unit that includes a plurality of signal systems corresponding one-to-one to the plurality of actuators, the signal systems providing a drive signal to the corresponding actuators on the basis of the same audio signal, the drive signal generated by at least one signal system of the signal systems being controlled by the control signal.

(15)

A speaker driving method including:

generating a control signal on the basis of detection signals generated by a plurality of detection units that is disposed in one-to-one correspondence with a plurality of actuators that vibrates a diaphragm, and detects vibration conditions; and controlling, by the control signal, a drive signal of at least one signal system of a plurality of signal systems corresponding one-to-one to the plurality of actuators, the signal systems providing a drive signal to the corresponding actuators on the basis of the same audio signal.

REFERENCE SIGNS LIST

1 Speaker apparatus
2 Speaker unit
3 Diaphragm
4 Edge
5 Frame
5*a* Screw hole
6 Screw
11, 12, 13, and 14 Actuator
21 Signal processing unit
22 Power amplifier
23 Driver
24 Sensor
30 Optimization calculation unit
31 Adder
32 Averaging operation unit
33, 34, 35, 36 Subtractor
37, 38, 39, 40 Gain amplifier
51 Voice coil cap
52 Voice coil bobbin
53 Damper
54 Magnet
55 Voice coil
56 Short ring
57 Yoke
58 Subframe
60 Control signal generation unit
70 Signal processing unit
71 First signal system
72 Second signal system
73 Third signal system
74 Fourth signal system
80 Speaker cabinet

The invention claimed is:

1. A speaker drive unit, comprising:

a control signal generation unit configured to:

generate, based on detection signals generated by a plurality of detection units, a control signal to make the detection signals uniform, wherein the plurality of detection units is in one-to-one correspondence with a plurality of actuators that vibrates a diaphragm, and the plurality of detection units detects vibration conditions of the diaphragm; and a signal processing unit that includes a plurality of signal systems corresponding one-to-one to the plurality of actuators, wherein each of the plurality of signal systems is configured to provide a drive signal to a corresponding actuator of the plurality of actuators based on the same audio signal, and the drive signal provided by at least one signal system of the plurality of signal systems is controlled by the control signal.

2. The speaker drive unit according to claim 1, wherein the control signal generation unit is further configured to generate the control signal for each of the plurality of signal systems, and the drive signal of each of the plurality of signal systems is controlled by the control signal in the signal processing unit.

3. The speaker drive unit according to claim 1, wherein the control signal is a signal to control a gain of the drive signal of the at least one signal system.

4. The speaker drive unit according to claim 1, wherein the control signal is a signal to control a frequency response of the drive signal of the at least one signal system.

5. The speaker drive unit according to claim 1, wherein the control signal generation unit is further configured to generate the control signal for feedback control, based on the detection signals of acceleration of vibrations produced by the plurality of actuators.

6. The speaker drive unit according to claim 1, wherein the control signal generation unit is further configured to determine an average value of the detection signals of the plurality of detection units; and generates the control signal based on the average value.

7. The speaker drive unit according to claim 1, wherein the plurality of actuators drives the same diaphragm.

8. The speaker drive unit according to claim 1, wherein each of the plurality of actuators drives a different diaphragm.

9. The speaker drive unit according to claim 1, wherein the plurality of actuators vibrates an image display panel in a configuration in which the image display panel is used as the diaphragm.

10. The speaker drive unit according to claim 1, wherein the plurality of detection units is a plurality of acceleration detection units.

11. The speaker drive unit according to claim 1, wherein the plurality of detection units is a plurality of drive current detection units for the plurality of actuators.

12. The speaker drive unit according to claim 1, wherein the plurality of detection units comprises bridge circuits provided in drive signal paths for the plurality of actuators.

13. A speaker apparatus, comprising:

a diaphragm;

a plurality of actuators configured to vibrate the diaphragm;

a plurality of detection units in one-to-one correspondence with the plurality of actuators, wherein the plurality of detection units is configured to: detect vibration conditions of the diaphragm; and generate detection signals;

a control signal generation unit configured to generate, based on the detection signals generated by the plurality of detection units, a control signal to make the detection signals uniform; and a signal processing unit that includes a plurality of signal systems corresponding one-to-one to the plurality of actuators, wherein each of the plurality of signal systems is configured to provide a drive signal to a corresponding actuator of the plurality of actuators based on the same audio signal, and the drive signal provided by at least one signal system of the plurality of signal systems is controlled by the control signal.

14. A speaker driving method, comprising:

generating, based on detection signals generated by a plurality of detection units, a control signal to make the detection signals uniform, wherein the plurality of detection units is in one-to-one correspondence with a plurality of actuators that vibrates a diaphragm, and the plurality of detection units detects vibration conditions of the diaphragm; and controlling, by the control signal, a drive signal of at least one signal system of a plurality of signal systems corresponding one-to-one to the plurality of actuators, wherein each of the plurality of signal systems provides the drive signal to a corresponding actuator of the plurality of actuators based on the same audio signal.

15. A speaker drive unit, comprising:

a control signal generation unit configured to:

determine an average value of detection signals of a plurality of detection units, wherein the plurality of detection units is in one-to-one correspondence with a plurality of actuators that vibrates a diaphragm, the plurality of detection units detects vibration conditions of the diaphragm; and generate a control signal based on the average value; and a signal processing unit that includes a plurality of signal systems corresponding one-to-one to the plurality of actuators, wherein each of the plurality of signal systems is configured to provide a drive signal to a corresponding actuator of the plurality of actuators based on the same audio signal, and the drive signal provided by at least one signal system of the plurality of signal systems is controlled by the control signal.

* * * * *